US006965393B2

(12) United States Patent
Ishida et al.

(10) Patent No.: US 6,965,393 B2
(45) Date of Patent: Nov. 15, 2005

(54) IMAGE FORMING APPARATUS

(75) Inventors: Hideki Ishida, Osaka (JP); Eiji Tatsumi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 174 days.

(21) Appl. No.: 10/699,702

(22) Filed: Nov. 4, 2003

(65) Prior Publication Data

US 2004/0095455 A1 May 20, 2004

(30) Foreign Application Priority Data

Nov. 11, 2002 (JP) ..... 2002-326445
Nov. 11, 2002 (JP) ..... 2002-326446
Nov. 11, 2002 (JP) ..... 2002-326464
Nov. 11, 2002 (JP) ..... 2002-326507

(51) Int. Cl.[7] ..... B41J 2/45
(52) U.S. Cl. ..... 347/240; 347/252; 347/131
(58) Field of Search ..... 347/240, 251, 347/252, 237, 247, 183, 184, 130, 131; 358/521, 358/530, 534, 535

(56) References Cited

U.S. PATENT DOCUMENTS 6,693,659 B2 * 2/2004 Okumura et al. ..... 347/240

FOREIGN PATENT DOCUMENTS

JP 2002-248808 9/2002

* cited by examiner

*Primary Examiner*—Huan Tran
(74) *Attorney, Agent, or Firm*—Smith, Gambrell & Russell, LLP

(57) ABSTRACT

An image forming apparatus is provided that is capable of forming an image with excellent gradation quality without affected by variations in the sensitivity characteristic of the photoreceptor and the light quantity characteristic of the LED print head among individual products. A highest gradation appropriate exposure amount appropriate for the highest gradation is calculated from the sensitivity characteristic of the photoreceptor and the light quantity characteristic of the LED print head. Then, based on the highest gradation appropriate exposure amount, an appropriate lighting time of the LEDs that is appropriate for each gradation is calculated so that the increment of the exposure amount between the gradations including the first gradation, and the lighting times of the gradations are set based on the appropriate lighting times. Then, the LEDs are lit for the lighting time set in accordance with the gradation of the inputted image data.

15 Claims, 10 Drawing Sheets

IMAGE FORMING APPARATUS

BACKGROUND OF THE INVENTION

1. Field of the Invention

The present invention relates to an image forming apparatus such as a copier, a facsimile apparatus or a printer, and more particularly, to an electrophotographic image forming apparatus having an LED (Light Emitting Diode) print head capable of exposing the surface of the photoreceptor in a plurality of gradations.

2. Description of the Prior Art

Generally, in image forming apparatuses, light of a quantity corresponding to the gradation of the inputted image data is applied from the LED print head to the photoreceptor, and by doing this, the surface of the photoreceptor is exposed to thereby form an electrostatic latent image of the input image. The LED print head is opposed to the surface of the drum-shaped photoreceptor with a predetermined distance in between, and extends in the axial direction of the photoreceptor. In the LED print head, for example, approximately 7000 LEDs are linearly arranged in accordance with the resolution.

The lighting time of the LEDs of the LED print head is changed so as to correspond to the gradation of the image data by being controlled by a preset gradation pulse of a lighting clock. For example, for high gradations, the lighting time is increased so that the exposure amount of the photoreceptor surface that is substantially proportional to the lighting time is increased, whereas for low gradations, the lighting time is decreased so that the exposure amount of the photoreceptor surface is decreased. Consequently, for the former high gradations, the amount of toner adhering to the exposed area increases, so that an image with high density is developed, whereas for the latter low gradations, the amount of toner adhering to the exposed area decreases, so that a light image is developed.

In the above-mentioned conventional lighting clock, the increment of the gradation pulse between the gradations is fixed so that the increment of the lighting time between the gradations is fixed. However, the relationship between the lighting time of the LEDs, that is, the exposure amount of the photoreceptor surface and the amount of toner adhering to the exposed area (the toner image density (ID)) is not uniformly linear, but there are nonlinear parts in the initial and closing stages (see FIG. 10). Therefore, even if the lighting time is linearly increased, that is, is made linear in light quantity in proportion to the gradation of the input image data, the relationship between the gradation of the input image data and the density of the formed toner image is not linear. In particular, for low gradations and high gradations, the density of the toner image and the density of the input image data are subtly different.

To solve such a problem, as a conventional improved technology, an image forming apparatus comprising the following has been proposed: setting means for nonlinearly setting an appropriate lighting time appropriate for each gradation so that the increment of the toner image density between the gradations is fixed based on the correlation between the toner image density and the lighting time, forming a lighting clock having a gradation pulse coinciding with a multiple of a reference pulse of its own reference clock with substantially the same timing as the appropriate lighting times, and setting the formed lighting clock; and LED driving means for counting the number of gradation pulses by receiving the lighting clock set by the setting means in accordance with the gradation of the inputted image data and lighting the LEDs until each number of gradations is reached (for example, see Japanese Laid-Open Patent Application No. 2002-248808 [pages 2–7, FIGS. 8 and 9]). According to such an image forming apparatus of the improved technology, LEDs are lit under a condition where for low gradations and high gradations, the lighting time, that is, the increment of the gradation pulse is set to a high value and for intermediate gradations, it is set to a value lower than that in order that the toner image density substantially corresponds to the gradation of the input image data, so that the density of the toner image and the density of the input image data are the same over the entire gradation range. Thus, the above-mentioned problem is tolerably solved.

In the sensitivity characteristic of the photoreceptor surface, there are variations of a certain extent among individual products, and in the light quantity characteristic of the LEDs of the LED print head, there are also variations by approximately (the highest value/the lowest value at the light quantity of the same lighting time)>2 among individual products. Consequently, the exposure performance varies among image forming apparatuses according to the combination of the photoreceptor and the LED print head provided in the image forming apparatus. According to the conventional lighting clock, since the increment of the gradation pulse between the gradations is fixed, the variation amount cannot be permitted, so that the toner image density gradually significantly varies from intermediate to high gradations among image forming apparatuses.

Moreover, LEDs cannot always emit a stable quantity of light immediately after the start of lighting, and in actuality, a loss time during which no exposure is performed is present immediately after lighting. Consequently, unless the lighting time (gradation pulse) of the LEDs is set with consideration given the loss time, for low gradations, particularly for the first gradation, the lighting time is substantially short and the desired exposure amount cannot be obtained, so that an image commensurate with the gradation is not formed.

On the other hand, in the case of the above-described conventional improved technology, since the lighting clock is formed from the reference clock, gradation pulses of the lighting clock that are suitable for each image forming apparatus can be freely set somehow or other. However, since the sensitivity characteristic of the photoreceptor surface is not sufficiently considered in setting the gradation pulses, it cannot be said that variations in exposure performance among image forming apparatuses can be handled.

In this improved technology, examining the relationship between variations in the sensitivity characteristic of the photoreceptor and the light quantity characteristic of the LEDs and appropriate lighting times $T_{1/16}$, $T_{2/16}$, . . . , and $T_{15/16}$ of the gradations, when the photoreceptor sensitivity characteristic and the LED light quantity characteristic are both the lowest values, as shown in FIG. 11, a sufficient increment width of the gradation pulse can be secured even in the case of intermediate gradations where the increment of the appropriate lighting time is small. However, when the photoreceptor sensitivity characteristic and the LED light quantity characteristic are both the highest values, as shown in FIG. 12, the increment width of the appropriate lighting time in intermediate gradations is extremely small, so that it is difficult to secure the increment width of the gradation pulse. This is because although the increment width of the gradation pulse coincides with a multiple of the reference pulse of the reference clock with substantially the same timing as the increment width of the appropriate lighting time, in actuality, it is restricted by the minimum width that the reference pulse can have. Thus, this improved technology leaves a problem in practicality. Needless to say, it is difficult to reflect the above-mentioned loss time.

SUMMARY OF THE INVENTION

The present invention is made in view of the above-mentioned problems, and an object thereof is to provide an image forming apparatus capable of forming an image with excellent gradation quality without affected by variations in the sensitivity characteristic of the photoreceptor and the light quantity characteristic of the LED print head among individual products.

Another object of the present invention is to provide an image forming apparatus capable of forming an image with excellent gradation quality with consideration given to the loss time at the time of start of lighting of the LEDs without affected by variations in the sensitivity characteristic of the photoreceptor and the light quantity characteristic of the LED print head among individual products.

To achieve the above-mentioned objects, according to the present invention, in an image forming apparatus having an LED print head where a multiplicity of LEDs capable of exposing a surface of a photoreceptor in a plurality of gradations are arranged, the following are provided: setting means for calculating a highest gradation appropriate exposure amount appropriate for a highest gradation from a sensitivity characteristic of the photoreceptor and a light quantity characteristic of the LED print head, calculating a highest gradation appropriate lighting time of the LEDs that is appropriate for the highest gradation and an appropriate lighting time of the LEDs that is appropriate for each of other gradations based on the highest gradation appropriate exposure amount, and setting a lighting time of each gradation based on the highest gradation appropriate lighting time and each appropriate lighting time; and LED driving means for lighting the LEDs for the lighting time set by the setting means in accordance with a gradation of inputted image data.

Moreover, in an image forming apparatus having an LED print head where a multiplicity of LEDs capable of exposing a surface of a photoreceptor in a plurality of gradations are arranged, the following may be provided: setting means for calculating a highest gradation appropriate exposure amount appropriate for a highest gradation from a sensitivity characteristic of the photoreceptor and a light quantity characteristic of the LED print head, calculating an appropriate lighting time of the LEDs that is appropriate for each gradation so that an increment of an exposure amount between the gradations including a first gradation is fixed based on the highest gradation appropriate exposure amount, and setting a lighting time of each gradation based on each appropriate lighting time; and LED driving means for lighting the LEDs for the lighting time set by the setting means in accordance with a gradation of inputted image data.

Moreover, according to the present invention, in an image forming apparatus having an LED print head where a multiplicity of LEDs capable of exposing a surface of a photoreceptor in a plurality of gradations are arranged, the following are provided: setting means for calculating a highest gradation appropriate exposure amount appropriate for a highest gradation from a sensitivity characteristic of the photoreceptor and a light quantity characteristic of the LED print head, calculating a highest gradation appropriate lighting time of the LEDs that is appropriate for the highest gradation and an appropriate lighting time of the LEDs that is appropriate for each of other gradations based on the highest gradation appropriate exposure amount, forming a lighting clock having a gradation pulse coinciding with a multiple of a reference pulse of its own reference clock with timing substantially the same as the highest gradation appropriate lighting time and each appropriate lighting time, and setting the formed lighting clock; and LED driving means for counting the number of gradation pulses by receiving the lighting clock set by the setting means in accordance with a gradation of inputted image data, and lighting the LEDs until each number of gradations is reached.

Moreover, in an image forming apparatus having an LED print head where a multiplicity of LEDs capable of exposing a surface of a photoreceptor in a plurality of gradations are arranged, the following may be provided: setting means for calculating a highest gradation appropriate exposure amount appropriate for a highest gradation from a sensitivity characteristic of the photoreceptor and a light quantity characteristic of the LED print head, calculating an appropriate lighting time of the LEDs that is appropriate for each gradation so that an increment of an exposure amount between the gradations including a first gradation is fixed based on the highest gradation appropriate exposure amount, forming a lighting clock having a gradation pulse coinciding with a multiple of a reference pulse of its own reference clock with timing substantially the same as each appropriate lighting time, and setting the formed lighting clock; and LED driving means for counting the number of gradation pulses by receiving the lighting clock set by the setting means in accordance with a gradation of inputted image data, and lighting the LEDs until each number of gradations is reached.

In such an image forming apparatus, the final lighting time of each gradation can be set after the highest gradation appropriate exposure amount appropriate for the highest gradation is calculated and the appropriate lighting time of the LEDs that is appropriate for each gradation is calculated in consideration of variations among image forming apparatuses in the sensitivity characteristic of the photoreceptor and the light quantity characteristic of the LED print head which are varying elements of the exposure performance. Since the LEDs are lit for the set lighting time in accordance with the gradation of the input image data, even if there are variations in the sensitivity characteristic of the photoreceptor and the light quantity characteristic of the LED print head, an image with excellent gradation quality corresponding to the gradations can be formed over the entire gradation range.

Moreover, to achieve the above-mentioned objects, according to the present invention, in an image forming apparatus having an LED print head where a multiplicity of LEDs capable of exposing a surface of a photoreceptor in a plurality of gradations are arranged, the following are provided: setting means for calculating a highest gradation appropriate exposure amount appropriate for a highest gradation from a sensitivity characteristic of the photoreceptor and a light quantity characteristic of the LED print head, calculating a highest gradation appropriate lighting time of the LEDs that is appropriate for a highest gradation and to which a loss time at the time of start of lighting is added and an appropriate lighting time of the LEDs that is appropriate for each of other gradations and to which the loss time is added based on the highest gradation appropriate exposure amount, and setting a lighting time of each gradation based on the highest gradation appropriate lighting time and each appropriate lighting time; and LED driving means for lighting the LEDs for the lighting time set by the setting means in accordance with a gradation of inputted image data.

Moreover, in an image forming apparatus having an LED print head where a multiplicity of LEDs capable of exposing a surface of a photoreceptor in a plurality of gradations are arranged, the following may be provided: setting means for calculating a highest gradation appropriate exposure amount appropriate for a highest gradation from a sensitivity characteristic of the photoreceptor and a light quantity characteristic of the LED print head, calculating an appropriate lighting time of the LEDs that is appropriate for each gradation and to which a loss time at the time of start of lighting is added so that an increment of an exposure amount between the gradations including a first gradation is fixed based on the highest gradation appropriate exposure amount, forming a lighting clock having a gradation pulse coinciding with a multiple of a reference pulse of its own reference clock with timing substantially the same as each appropriate lighting time, and setting the formed lighting clock; and LED driving means for counting the number of gradation pulses by receiving the lighting clock set by the setting means in accordance with a gradation of inputted image data, and lighting the LEDs until each number of gradations is reached.

In such an image forming apparatus, the final lighting time of each gradation to which the loss time is added can be set after the highest gradation appropriate exposure amount appropriate for the highest gradation is calculated and the appropriate lighting time of the LEDs that is appropriate for each gradation is calculated in consideration of variations among image forming apparatuses in the sensitivity characteristic of the photoreceptor and the light quantity characteristic of the LED print head which are varying elements of the exposure performance. Since the LEDs are lit for the set lighting time in accordance with the gradation of the input image data, even if there are variations in the sensitivity characteristic of the photoreceptor and the light quantity characteristic of the LED print head, an image with excellent gradation quality corresponding to the gradations can be formed over the entire gradation range.

BRIEF DESCRIPTION OF THE DRAWINGS

These and other objects and features of this invention will become clear from the following description, taken in conjunction with the preferred embodiments with reference to the accompanying drawings in which.

DESCRIPTION OF THE PREFERRED EMBODIMENTS

Figure 1A:
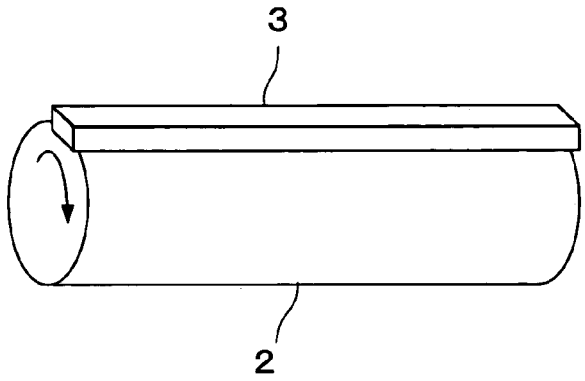
FIGS. 1A and 1B are external views showing the positional relationship between a photoreceptor and an LED print head in an image forming apparatus according to a first embodiment of the present invention.
Figure 1B:
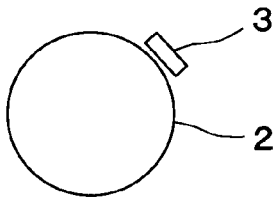
Figure 2:
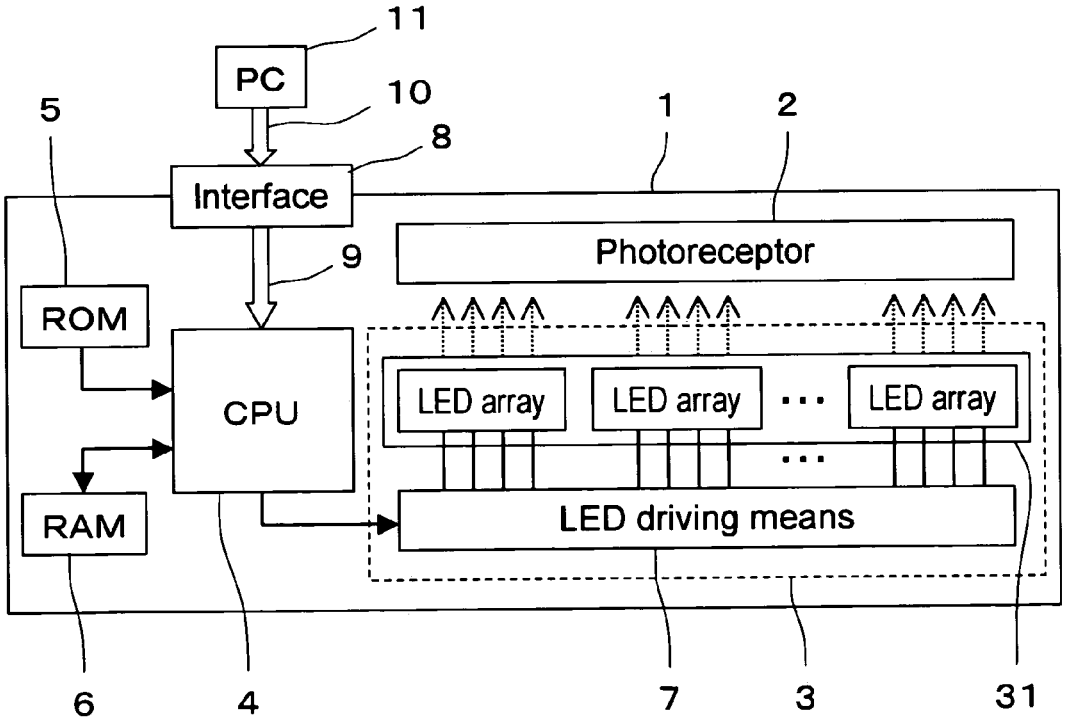
FIG. 2 is a block diagram showing the structure of the image forming apparatus according to the first embodiment.

Embodiments of the present invention will be described with reference to the drawings. First, a printer which is an example of an image forming apparatus according to a first embodiment of the present invention will be described. FIGS. 1A and 1B are external views showing the positional relationship between a photoreceptor and an LED print head in the image forming apparatus according to the first embodiment. FIG. 1A is a perspective view, and FIG. 1B is a view of the photoreceptor viewed from the axial direction. FIG. 2 is a block diagram showing the structure of the image forming apparatus. In the figures, parts having the same names and performing the same functions are denoted by the same reference numerals.

First, the photoreceptor 2 and the LED print head 3 in the image forming apparatus 1 will be described. As shown in FIGS. 1A and 1B, the photoreceptor 2 has a shape of a cylinder elongated in the axial direction, that is, a shape of a drum, and has a photoreceptor layer of amorphous silicon (a-Si) on its surface. The photoreceptor layer is uniformly charged to a predetermined potential by a discharger (not shown) as the photoreceptor 2 rotates axially.

The LED print head 3 is opposed to the surface of the photoreceptor 2 with a predetermined distance in between, and extends in the axial direction of the photoreceptor 2. Specifically, in the case of an image forming apparatus capable of forming an image with a resolution of 600 dpi on Japanese Industrial Standards A3-size sheets, an LED head 31 where approximately 7000 LEDs are linearly arranged in the axial direction of the photoreceptor 2 is disposed so as to be opposed to the surface of the photoreceptor 2. Further, to each LED, a driver controlling its lighting is connected. The LEDs are turned on and off, that is, the lighting time thereof is changed so as to correspond to the gradation of the input image data by a gradation pulse of a lighting clock (hereinafter, sometimes abbreviated as "SCLK") detailed later. For example, in high gradations, the lighting time is increased so that the exposure amount of the photoreceptor surface substantially proportional thereto is increased, whereas in low gradations, the lighting time is decreased so that the exposure amount of the photoreceptor surface is decreased.

The image forming apparatus 1 including the photoreceptor 2 and the LED print head 3 is mainly provided with, as shown in FIG. 2: a CPU 4; a ROM 5 in which setting expressions for setting the SCLK are stored; a RAM 6 in which the SCLK is stored; LED driving means 7 for lighting the LEDs; a network interface 8; and an internal bus 9. Image data is inputted, for example, from a personal computer 11 connected through a network cable 10.

Now, a method of setting the SCLK will be described. The SCLK is set for each individual image forming apparatus 1 in accordance with the sensitivity characteristic of the photoreceptor 2 and the light quantity characteristic of the LED print head provided in the apparatus. First, a highest gradation appropriate exposure amount E [$\mu$J/cm$^2$] appropriate for the highest gradation is calculated by the following expression (1) based on the sensitivity characteristic:

$$E=a\cdot E_{1/2}=a\cdot E'\cdot(V_0-V_{1/2})/(V_0-V) \qquad \text{Expression (1)}$$

Here, a is a fixed coefficient, $E_{1/2}$ is the half decay exposure amount [$\mu$J/cm$^2$], E' is the exposure amount of the photoreceptor when sensitivity is measured, $V_0$ is the dark potential [V] of the photoreceptor, and $V_{1/2}$ is the light potential [V] at the time of half decay exposure. V is the light potential [V] when exposure is performed with the exposure amount of the photoreceptor when sensitivity is measured, that is, the exposure amount E', and corresponds to the sensitivity characteristic of the photoreceptor 2 which is a varying element of the exposure performance.

In the present embodiment, as a, 2 to 3.5 is adopted, as E', 0.15 [$\mu$J/cm$^2$] assumed to be close to the half decay exposure amount is adopted, as $V_0$, 300 [V] is adopted, and as $V_{1/2}$, 160 [V] is adopted.

Then, an appropriate lighting time $T_{n/m}$ of the LEDs that is appropriate for each gradation is calculated by the following expression (2) based on the highest gradation appropriate exposure amount E calculated by Expression (1) and the LED light quantity characteristic:

$$T_{n/m}=\{n/(m-1)\}\cdot(E\cdot 2.54^2\cdot 10^6)/(P\cdot M\cdot N)+\Delta T \qquad \text{Expression (2)}$$

Here, $T_{n/m}$ is the appropriate lighting time [$\mu$s] of the n-th gradation, $\Delta T$ is the loss time [$\mu$s] at the time of start of lighting, m is the number of gradations, n is the n-th gradation (=0, 1, . . . , and m−1), M is the main scanning resolution [dpi], and N is the sub scanning resolution [dpi]. P is the average light quantity [$\mu$W/dot] per LED, and corresponds to the light quantity characteristic of the LED print head which is a varying element of the exposure performance.

That is, by Expression (2), the appropriate lighting time $T_{n/m}$ is calculated so that the increment of the exposure amount between the gradations including the first gradation is fixed based on the highest gradation appropriate exposure amount E. In the present embodiment, as $\Delta T$, 0.2 [$\mu$s] is adopted, as M, 600 [dpi] is adopted, as N, 600 [dpi] or 1800 [dpi] is adopted, and as m, 16 is adopted when N is 600 [dpi] and 6 is adopted when N is 1800 [dpi].

Figure 3:
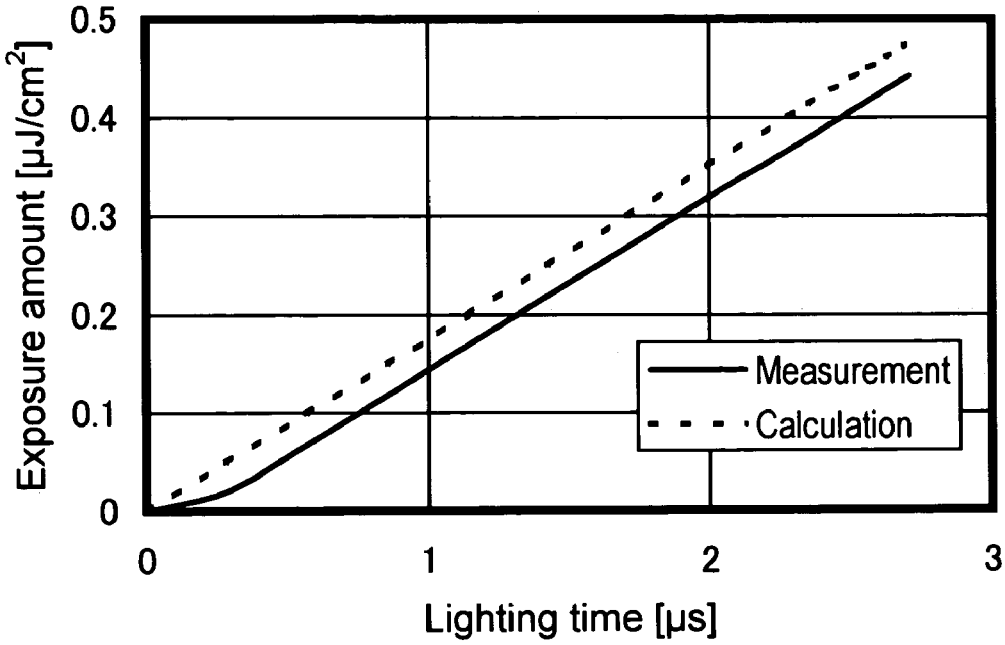
FIG. 3 is a view showing the correlation between the lighting time of LEDs and the exposure amount of the photoreceptor surface.
Figure 4:
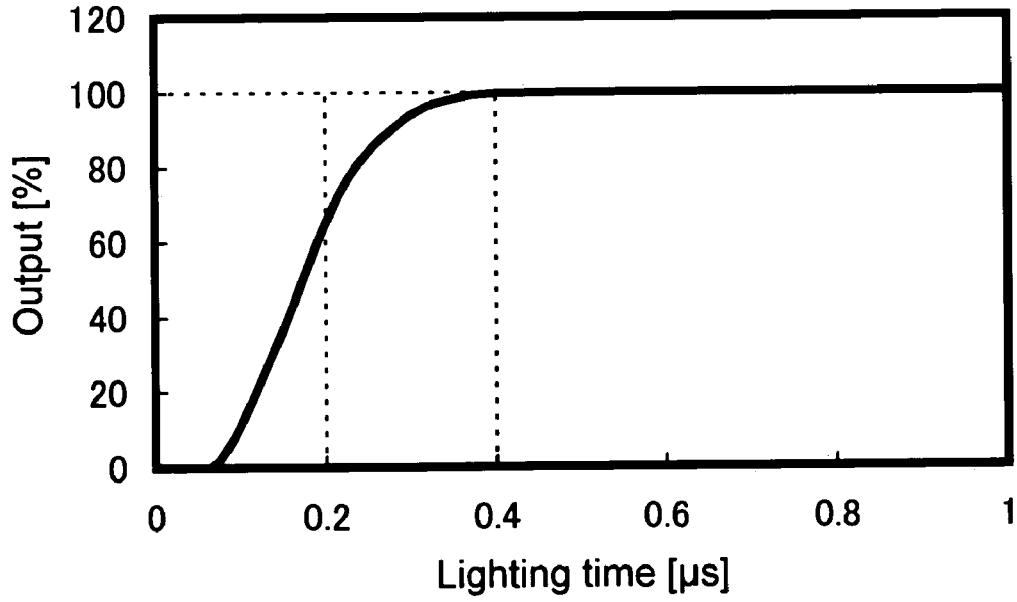
FIG. 4 is a view showing the correlation between the lighting time of the LEDs and the output.

Now, the loss time $\Delta T$ will be described with reference to FIGS. 3 and 4. Generally, the correlation between the lighting time of the LEDs and the exposure amount of the photoreceptor surface is a proportional relationship in calculation. In actuality, however, a loss time during which no exposure is performed occurs immediately after the start of lighting (see FIG. 3). This is because, as is apparent from the correlation between the lighting time of the LEDs and the output (see FIG. 4), immediately after lighting the output gradually increases to reach a steady state where the output is 100%. Therefore, as shown in Expression (2), the loss time $\Delta T$ during which substantially no exposure is performed is added to obtain the appropriate lighting time $T_{n/m}$ of each gradation. FIGS. 3 and 4 show a condition where the output reaches the steady state in approximately 0.4 [$\mu$s] and the loss time $\Delta T$ is 0.2 [$\mu$s].

Figure 5:
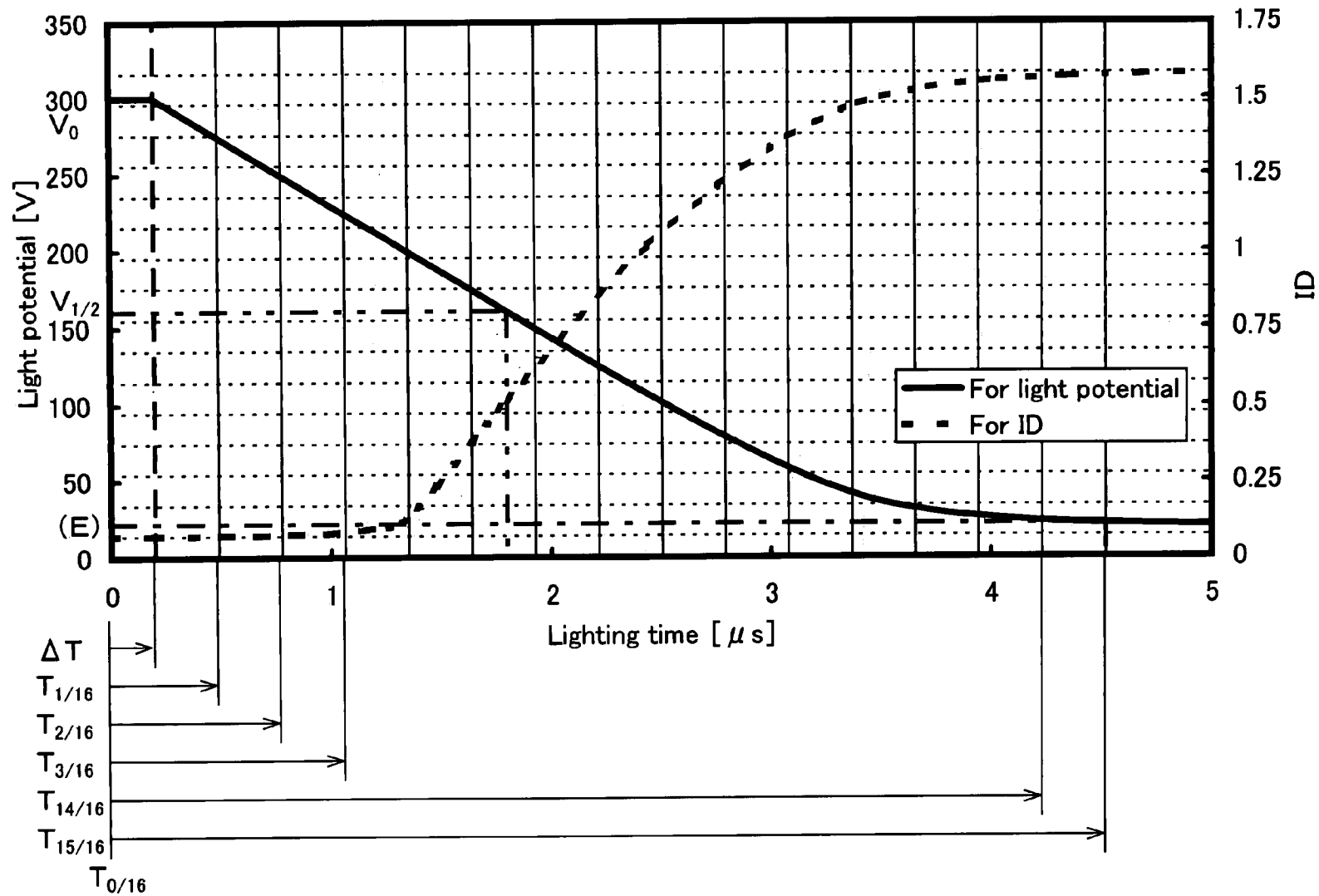
FIG. 5 is a view showing the relationship between the appropriate lighting time, and the light potential of the photoreceptor and the density of the toner image when the exposure performance is the lower limit of the variations in the image forming apparatus according to the first embodiment.
Figure 6:
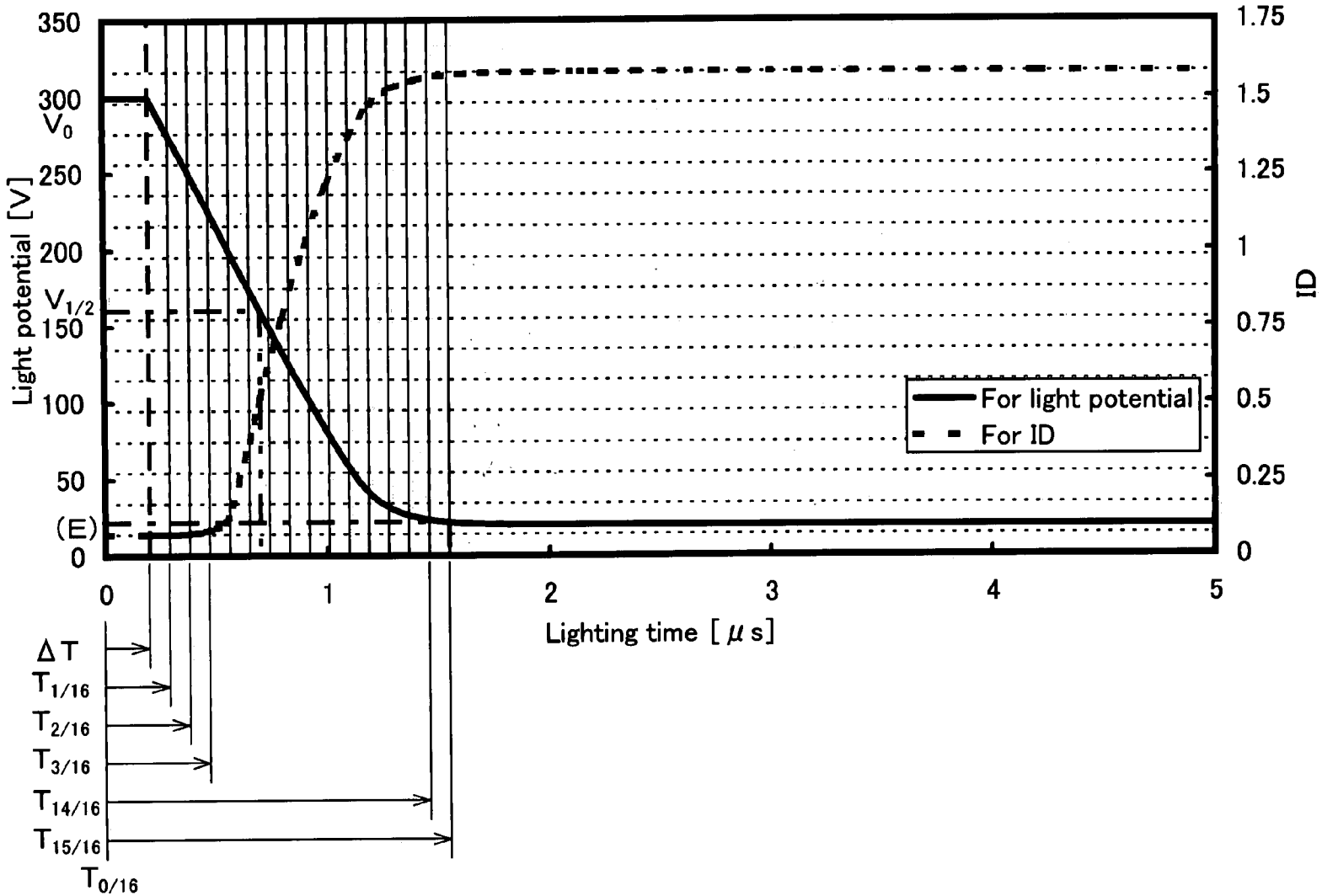
FIG. 6 is a view showing the relationship between the appropriate lighting time, and the light potential of the photoreceptor and the density of the toner image when the exposure performance is the upper limit of the variations in the image forming apparatus according to the first embodiment.

An example of the relationship between the appropriate lighting time $T_{n/m}$ calculated by Expression (2) as described above, and the light potential of the photoreceptor and the toner image density (ID) (a case where m=16, n=0, 1, . . . , and 15) is shown in FIGS. 5 and 6. FIG. 5 shows a case where the exposure performance is the lower limit of the variations in which the photoreceptor sensitivity characteristic and the LED light quantity characteristic are both the lowest values, whereas FIG. 6 shows a case where the exposure performance is the upper limit of the variations in which the photoreceptor sensitivity characteristic and the LED light quantity characteristic are both highest values. In either case, the increment of the exposure amount between the gradations including the first gradation, that is, the increment of the appropriate lighting time $T_{n/m}$ ($T_{1/16}$, $T_{2/16}$, . . . , and $T_{15/16}$) is fixed. Here, the appropriate lighting time $T_{0/16}$ of the 0-th gradation means 0 (zero) [$\mu$s] where the LEDs remain off.

Figure 7:
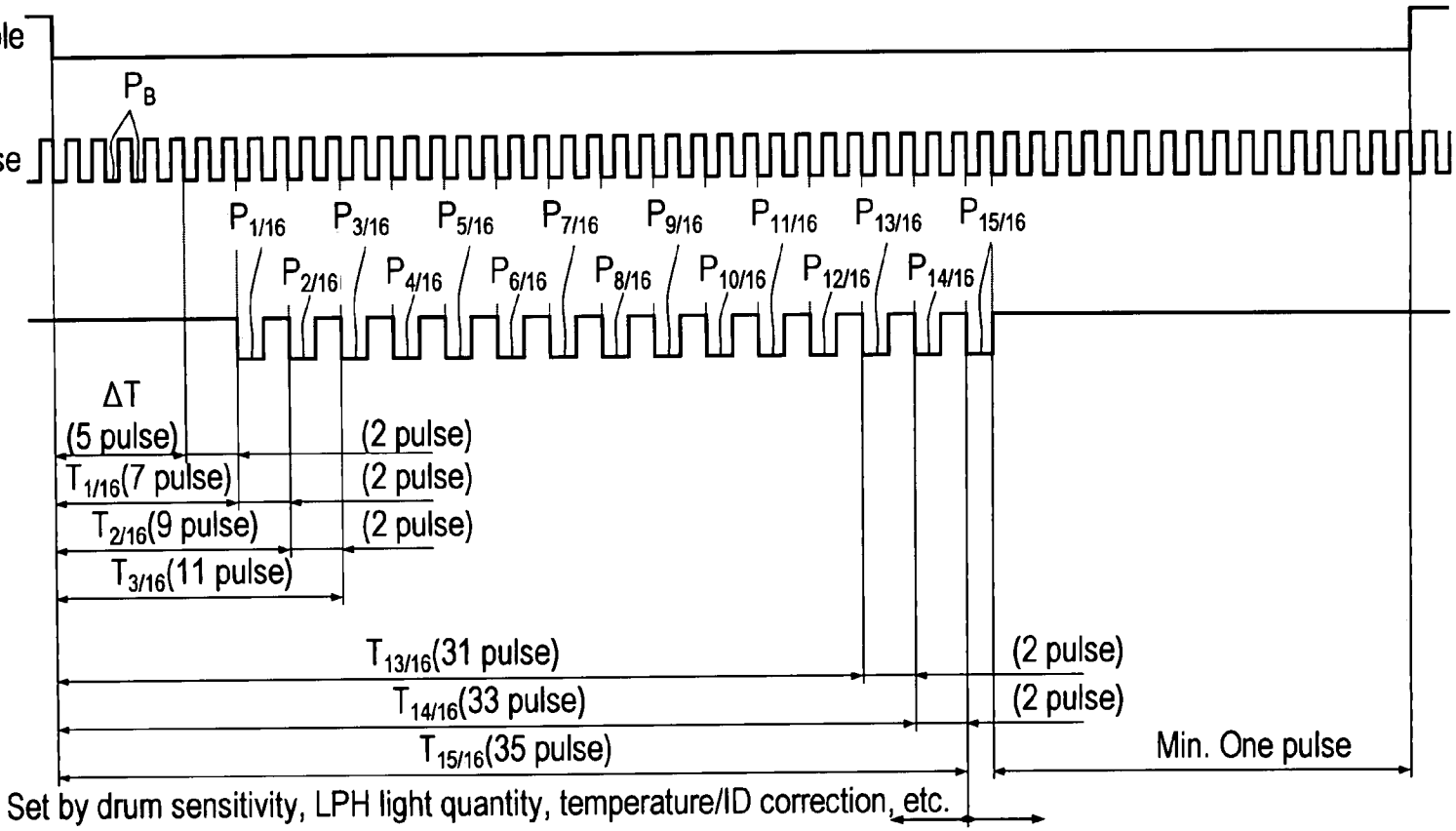
FIG. 7 is a schematic view showing the relationship between a reference clock and an SCLK in the image forming apparatus according to the first embodiment.

Subsequently, the SCLK formed based on the appropriate lighting time $T_{n/m}$ will be described with reference to FIG. 7. FIG. 7 is a schematic view showing the relationship between the reference clock and the SCLK.

As shown in FIG. 7, the reference clock is basically possessed by the above-mentioned CPU 4, and comprises a reference pulse $P_B$ repetitively outputted in fixed increments. Gradation pulses $P_{1/16}$, $P_{2/16}$, . . . , and $P_{15/16}$ coinciding with a multiple of the reference pulse $P_B$ are formed with substantially the same timing as the appropriate lighting times $T_{1/16}$, $T_{2/16}$, . . . , and $T_{15/16}$ of the gradations, and a lighting clock SCLK comprising these is formed. In FIG. 7, gradation pulses $P_{1/16}$, $P_{2/16}$, . . . , and $P_{15/16}$, in the following case, corresponding to the following appropriate lighting times $T_{1/16}$ to $T_{15/16}$, respectively, are generated: the increment of the reference pulse $P_B$ is 40 [ns] (corresponding to one pulse) and for the SCLK, the appropriate lighting time $T_{1/16}$ of the first gradation is approximately 280 [ns] (corresponding to seven reference pulses $P_B$), the appropriate lighting time $T_{2/16}$ of the second gradation is approximately 360 [ns] (corresponding to nine reference pulses $P_B$), the appropriate lighting time $T_{3/16}$ of the third gradation is approximately 440 [ns] (corresponding to eleven reference pulses $P_B$), . . . , and the appropriate lighting time $T_{15/16}$ of the fifteenth gradation is approximately 1400 [ns] (corresponding to thirty-five reference pulses $P_B$). Here, the increment between the gradation pulses $P_{1/16}$, $P_{2/16}$, . . . , and $P_{15/16}$ is a fixed value 80 [ns] (corresponding to two reference pulses $P_B$), and the appropriate lighting time $T_{1/16}$, $T_{2/16}$, . . . , and $T_{15/16}$ include a loss time $\Delta T$, at the time of start of lighting of the LEDs, of 200 [ns] (corresponding to five reference pulses $P_B$).

Figure 8A:
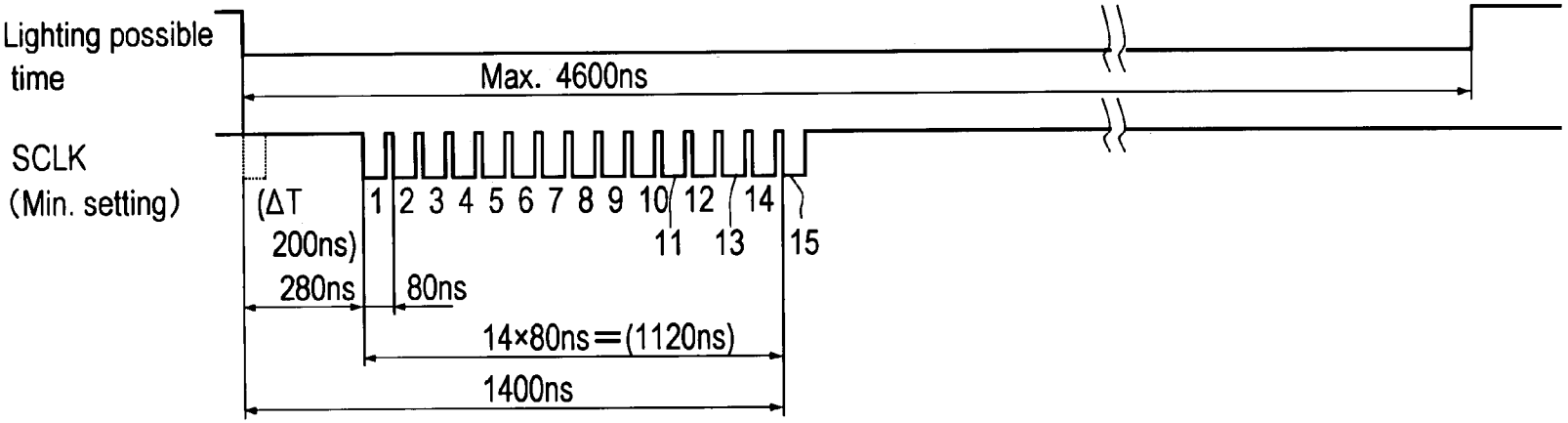
FIGS. 8A and 8B are schematic views showing various SCLKs in the image forming apparatus according to the first embodiment.
Figure 8B:
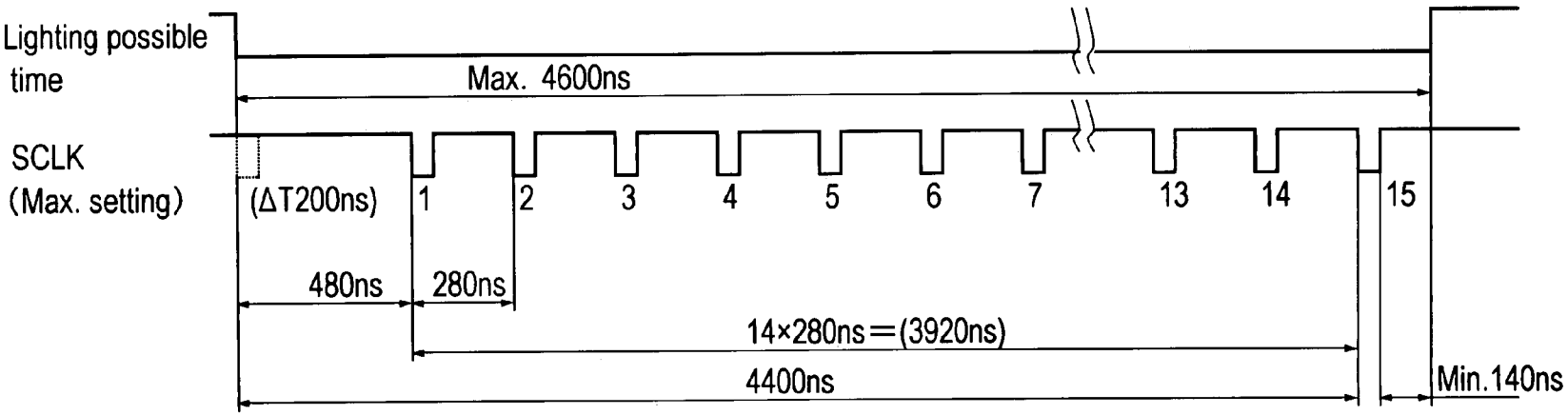

Another example of the SCLK is schematically shown in FIGS. 8A and 8B. FIG. 8A corresponds to FIG. 6, and shows an example when the exposure performance is the upper limit of the variations (substantially the same as FIG. 7). FIG. 8B corresponds to FIG. 5, and shows an example when the exposure performance is the lower limit of the variations. In both the cases of FIGS. 8A and 8B, the loss time $\Delta T$ is 200 [ns] (corresponding to five reference pulses $P_B$ in FIG. 7). The gradation pulse $P_{15/16}$ substantially corresponding to the appropriate lighting time $T_{15/16}$ of the fifteenth gradation which is the highest gradation corresponds to 1400 [ns] in the case of FIG. 8A (corresponding to 35 pulses $P_B$ in FIG. 7), whereas it corresponds to 4400 [ns] (corresponding to 100 pulses $P_B$ in FIG. 7). The increment between the gradation pulses $P_{1/16}$, $P_{2/16}$, . . . , and $P_{15/16}$ is 80 [ns] (corresponding to two pulses $P_B$ in FIG. 7) in the case of FIG. 8A, whereas it is 280 [ns] (corresponding to seven pulses $P_B$ in FIG. 7) in the case of FIG. 8B. Therefore, for example, the gradation pulse $P_{1/16}$ substantially corresponding to the appropriate lighting time $T_{1/16}$ of the first gradation corresponds to 280 [ns] (corresponding to seven reference pulses $P_B$ in FIG. 7) in the case of FIG. 8A, whereas it corresponds to 480 [ns] (corresponding to twelve pulses $P_B$ in FIG. 7) in the case of FIG. 8B.

The SCLK having the gradation pulses $P_{1/16}$, $P_{2/16}$, . . . , and $P_{15/16}$ formed in this manner is stored in the RAM 6. In the present embodiment, the above-described Expressions (1) and (2) are stored in the ROM 5, and the CPU 4 automatically calculates and forms the SCLK in accordance with various inputted parameters and sets the formed SCLK.

Subsequently, the lighting operation of the LEDs will be described. When image data is inputted, the CPU 4 transmits to the LED driving means 7 the number of gradations of each pixel in the image data and the SCLK extracted from the RAM 6. Then, the LED driving means 7 starts lighting of the LEDs in accordance with the input of the SCLK (here, lighting is not performed in the case of the 0-th gradation), and successively counts the number of gradation pulses $P_{1/16}$, $P_{2/16}$, . . . , and $P_{15/16}$ possessed by the SCLK. Then, the LED driving means 7 turns off the LEDs the instant when the count number becomes the number of gradations of the input. For example, when the number of gradations of the input is 2 (two gradations), after the first gradation pulse $P_{1/16}$ is counted, the second gradation pulse $P_{2/16}$ is counted and at the same time, the LEDs are turned off. That is, in this case, the LEDs are lit for the appropriate lighting time $T_{2/16}$ of the second gradation substantially corresponding to the gradation pulse $P_{2/16}$.

Therefore, according to the image forming apparatus of the present embodiment, since the LEDs can be lit for a lighting time substantially equal to an appropriate lighting time that is linear in light quantity and in accordance with the gradations of the input image data, an image with excellent gradation quality corresponding to the gradations can be formed over the entire gradation range. Further, since the lighting time is set in consideration of the sensitivity characteristic of the photoreceptor and the light quantity characteristic of the LED print head, no ill effect is produced by variations in the characteristics which are varying elements of the exposure performance. Further, since the loss time at the time of start of lighting of the LEDs is added, no problem occurs in the image in low gradations, particularly, the first gradation.

Moreover, in the present embodiment, since the appropriate lighting time of each gradation is calculated so that the increment of the exposure amount between the gradations including the first gradation is fixed, the lighting time linearly increases in proportion to the gradation of the input image data. However, since the calculation of the appropriate lighting time of each gradation is always based on the highest gradation appropriate exposure amount of each individual image forming apparatus, a distinct difference is not caused between the density of the toner image and the density of the input image data in low gradations and high gradations compared to the one where the increment of the gradation pulse is uniformly fixed like the conventional lighting clock.

Further, in the present embodiment, since the increment of the appropriate lighting time is fixed in consideration of the photoreceptor sensitivity characteristic and the LED light quantity characteristic, the increment width of the gradation pulse can be sufficiently secured irrespective of variations in the characteristics. Thus, the present embodiment can be said to be excellent in practicality compared to the conventional improved technology.

Subsequently, a second embodiment of the present invention will be described. The second embodiment is characterized in that Expression (2) in the first embodiment is modified so that changes in use environment, particularly in temperature, and changes in toner image density attendant thereon can be handled. That is, in the method of setting the SCLK, the appropriate lighting time $T_{n/m}$ [$\mu$s] of the LEDs that is appropriate for each gradation is calculated by the following Expression (3) instead of Expression (2):

$$T_{n/m}=\{n/(m-1)\}\cdot(E\cdot 2.54^2\cdot 10^6)/(P\cdot M\cdot N)\cdot(1+0.01\cdot\beta_1)/\{1+0.01\cdot\alpha_1\cdot(K'-K)\}+\Delta T\cdot(1+0.01\cdot\beta_2)/\{1+0.01\cdot\alpha_2\cdot(K'-K)\} \quad \text{Expression (3)}$$

Here, m, n, E, ΔT, M, N and P are similar to those described above. K is the temperature [° C.] detected by a temperature sensor, K' is the basic set temperature [° C.], $\alpha_1$ is the temperature correction coefficient [%/° C.] in the effective lighting time, $\alpha_2$ is the temperature correction coefficient [%/° C.] in the loss time at the time of start of lighting, $\beta_1$ is the image density correction coefficient [%] in the effective lighting time, and $\beta_2$ is the image density correction coefficient [%] in the loss time at the time of start of lighting.

In the present embodiment, as K', 23 [%/° C.] is adopted, as $\alpha_1$, −0.6 [° C.] is adopted, and as $\alpha_2$, 0 [%/° C.] is adopted. Then, based on the calculated appropriate lighting times, the SCLK is formed by a method similar to that of the first embodiment.

Consequently, according to the image forming apparatus of the present embodiment, compared to the first embodiment, since the appropriate lighting time can be corrected in accordance with the use environment, an image with excellent gradation quality can be formed with stability without restrained by the use environment.

Subsequently, a third embodiment of the present invention will be described. The third embodiment is characterized in that Expression (2) in the first embodiment is modified. That is, in the method of setting the SCLK, the highest gradation appropriate lighting time T [$\mu$s] of the LEDs that is appropriate for the highest gradation is calculated by the following Expression (4) instead of Expression (2):

$$T=(E\cdot 2.54^2\cdot 10^6)/(P\cdot M\cdot N)+\Delta T \quad \text{Expression (4)}$$

Here, E, ΔT, M, N and P are similar to those described above. The highest gradation appropriate lighting time T coincides with the appropriate lighting time $T_{15/16}$ of the fifteenth gradation in the example of the first embodiment (see FIGS. 5 and 6).

Together with this calculation, calculation of the appropriate lighting times of the LEDs that are appropriate for the other gradations is performed. In doing this, an appropriate lighting time that is linear in light quantity may be calculated in accordance with each gradation like in the first embodiment, or an appropriate lighting time that is linear in toner image density may be calculated like in the conventional improved technology. Then, based on the calculated appropriate lighting times, the SCLK is formed by a method similar to that of the first embodiment.

Thus, compared to the first embodiment, the image forming apparatus of the present embodiment is excellent in mobility when the appropriate lighting times other than the highest gradation appropriate lighting time are calculated.

Figure 9:
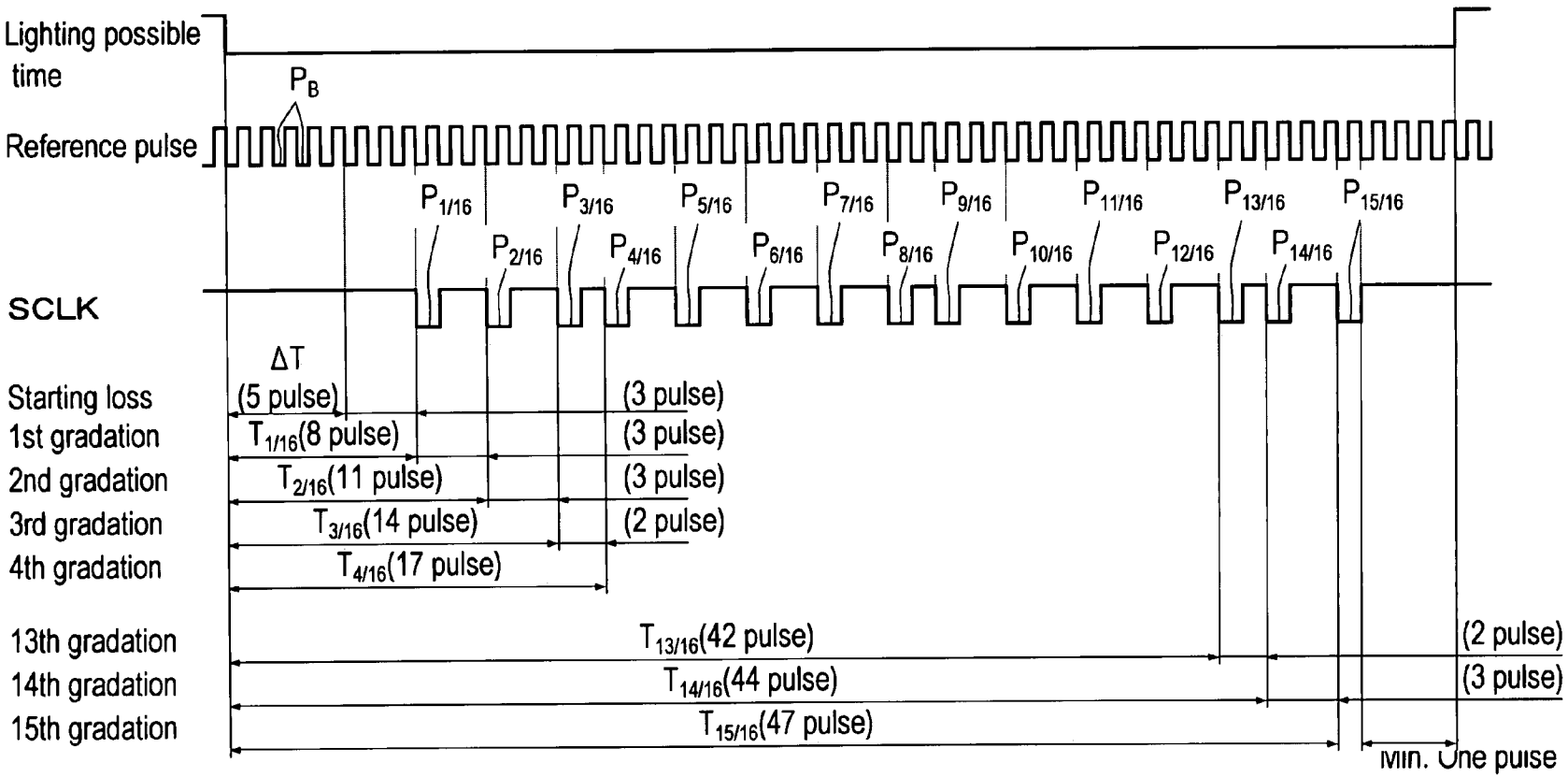
FIG. 9 is a schematic view showing the relationship between the reference clock and the SCLK in an image forming apparatus according to a fourth embodiment.
Figure 10:
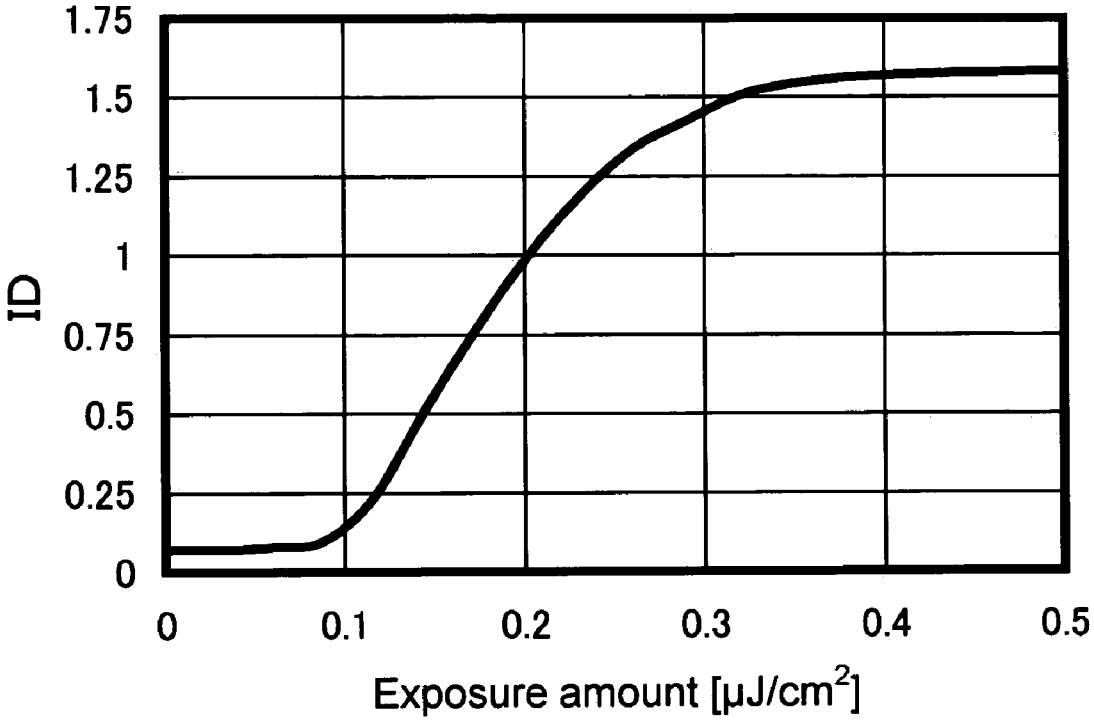
FIG. 10 is a view showing the correlation between the exposure amount of the conventional photoreceptor surface and the density of the toner image.
Figure 11:
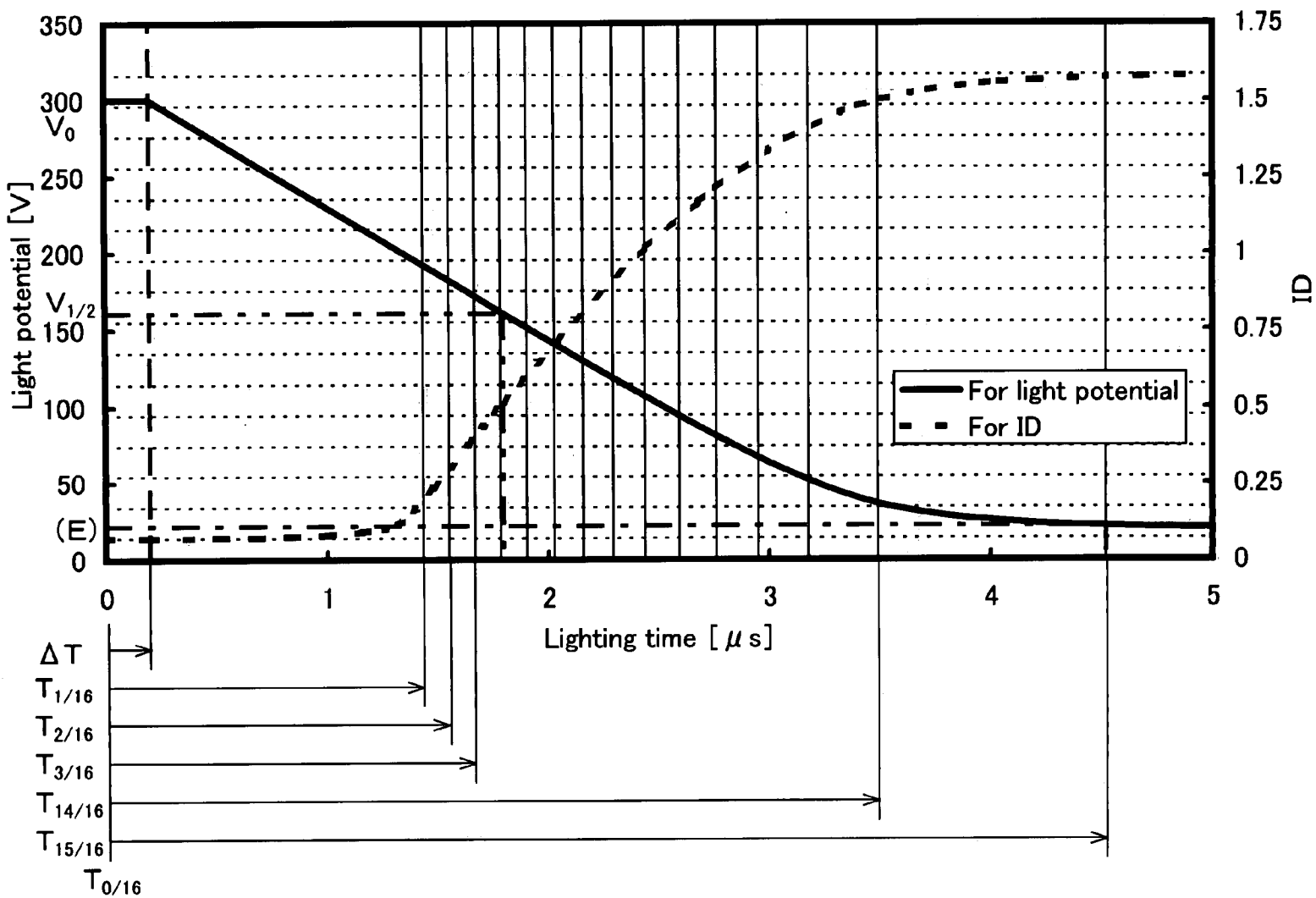
FIG. 11 is a view showing the relationship between the appropriate lighting time, and the light potential of the photoreceptor and the density of the toner image when the exposure performance is the lower limit of the variations in the conventional image forming apparatus.
Figure 12:
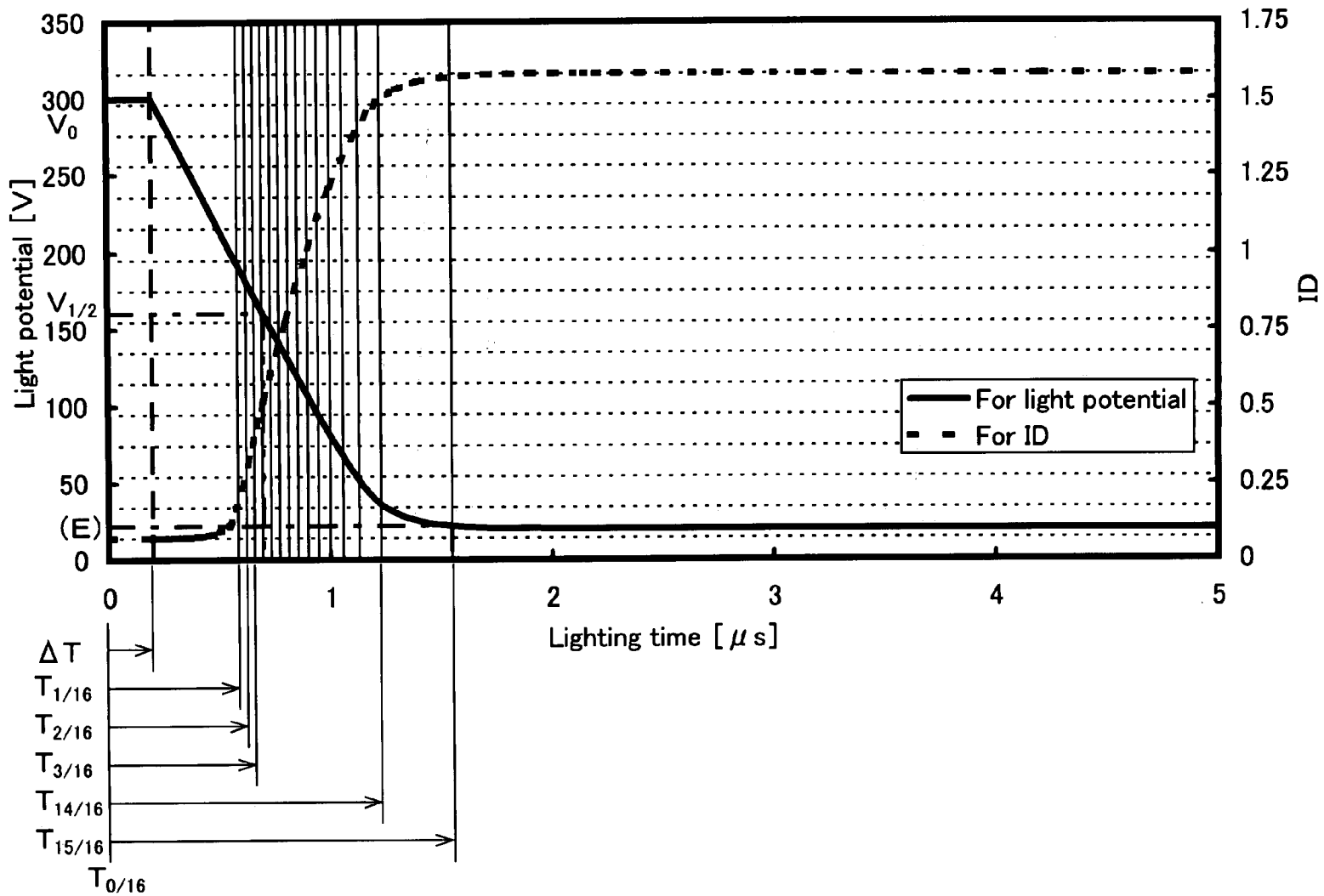
FIG. 12 is a view showing the relationship between the appropriate lighting time, and the light potential of the photoreceptor and the density of the toner image when the exposure performance is the upper limit of the variations in the conventional image forming apparatus.

Subsequently, a fourth embodiment of the present invention will be described with reference to FIG. 9. FIG. 9 is a schematic view showing the relationship between the reference clock and the SCLK in the fourth embodiment. In FIG. 9, parts having the same names and performing the same functions as those in the figures shown in the first embodiment are denoted by the same reference numerals, and no overlapping description is given.

The fourth embodiment is characterized in that the increment of the gradation pulses possessed by the SCLK in the first embodiment is made substantially fixed, although being nonuniform, in order that practicality increases. This is because when the SCLK is formed, the gradation pulses $P_{1/16}$, $P_{2/16}$, . . . , and $P_{15/16}$ coinciding with a multiple of the reference pulse $P_B$ are formed with substantially the same timing as the appropriate lighting times $T_{1/16}$, $T_{2/16}$, . . . , and $T_{15/16}$ of the gradations and there are gradations where the timing of the appropriate lighting time and the gradation pulse are significantly shifted from each other because of the relationship with the increment width of the reference pulse $P_B$.

Accordingly, in the present embodiment, as shown in FIG. 9, in the gradations where the timing of the appropriate lighting time and the gradation pulse are significantly shifted from each other, final gradation pulses are formed so that the shift is corrected. In FIG. 9, the gradation pulses $P_{4/16}$, $P_{9/16}$ and $P_{14/16}$ of the fourth, the ninth and the fourteenth gradations are corrected, and the increments of the gradation pulses $P_{3/16}$, $P_{8/16}$ and $P_{13/16}$ immediately preceding these pulses correspond to two reference pulses $P_B$. The increments of the other gradation pulses correspond to three reference pulses $P_B$.

According to the SCLK having such gradation pulses, since the LEDs can be lit for the lighting time substantially coinciding with the appropriate lighting time that is linear in light quantity and in accordance with each gradation of the input image data over the entire gradation range, practicality more increases.

Subsequently, a fifth embodiment of the present invention will be described. The fifth embodiment is characterized in that the first to the fourth embodiments are made effective use of. That is, an image forming apparatus of the present embodiment is suitable mainly for copiers for color printing, and has a plurality of image forming units each including the photoreceptor 2, the LED print head 3, a charger, a developer, a transferer and a charge remover. The image forming units each individually form an image of one of, for example, four colors of black, yellow, cyan and magenta, and in this case, four image forming units are provided. An appropriate SCLK is set for each photoreceptor 2 and LED print head 3 provided in each image forming unit, and the LEDs of the LED print head 3 in each image forming unit are lit in accordance with the gradation of the image of each color by each SCLK.

Obviously, many modifications and variations of the present invention are possible in light of the above teachings. It is therefore to be understood that within the scope of the appended claims, the invention may be practiced other than as specifically described.

What is claimed is:

1. An image forming apparatus having an LED print head where a multiplicity of LEDs capable of exposing a surface of a photoreceptor in a plurality of gradations are arranged, said image forming apparatus comprising:

setting means for calculating a highest gradation appropriate exposure amount appropriate for a highest gradation from a sensitivity characteristic of the photoreceptor and a light quantity characteristic of the LED print head, calculating a highest gradation appropriate lighting time of the LEDs that is appropriate for the highest gradation and an appropriate lighting time of the LEDs that is appropriate for each of other gradations based on the highest gradation appropriate exposure amount, and setting a lighting time of each gradation based on the highest gradation appropriate lighting time and each appropriate lighting time; and LED driving means for lighting the LEDs for the lighting time set by the setting means in accordance with a gradation of inputted image data.

2. An image forming apparatus having an LED print head where a multiplicity of LEDs capable of exposing a surface of a photoreceptor in a plurality of gradations are arranged, said image forming apparatus comprising:

setting means for calculating a highest gradation appropriate exposure amount appropriate for a highest gradation from a sensitivity characteristic of the photoreceptor and a light quantity characteristic of the LED print head, calculating an appropriate lighting time of the LEDs that is appropriate for each gradation so that an increment of an exposure amount between the gradations including a first gradation is fixed based on the highest gradation appropriate exposure amount, and setting a lighting time of each gradation based on each appropriate lighting time; and LED driving means for lighting the LEDs for the lighting time set by the setting means in accordance with a gradation of inputted image data.

3. An image forming apparatus having an LED print head where a multiplicity of LEDs capable of exposing a surface of a photoreceptor in a plurality of gradations are arranged, said image forming apparatus comprising:

setting means for calculating a highest gradation appropriate exposure amount appropriate for a highest gradation from a sensitivity characteristic of the photoreceptor and a light quantity characteristic of the LED print head, calculating a highest gradation appropriate lighting time of the LEDs that is appropriate for the highest gradation and an appropriate lighting time of the LEDs that is appropriate for each of other gradations based on the highest gradation appropriate exposure amount, forming a lighting clock having a gradation pulse coinciding with a multiple of a reference pulse of its own reference clock with timing substantially the same as the highest gradation appropriate lighting time and each appropriate lighting time, and setting the formed lighting clock; and LED driving means for counting the number of gradation pulses by receiving the lighting clock set by the setting means in accordance with a gradation of inputted image data, and lighting the LEDs until each number of gradations is reached.

4. An image forming apparatus having an LED print head where a multiplicity of LEDs capable of exposing a surface of a photoreceptor in a plurality of gradations are arranged, said image forming apparatus comprising:

setting means for calculating a highest gradation appropriate exposure amount appropriate for a highest gradation from a sensitivity characteristic of the photoreceptor and a light quantity characteristic of the LED print head, calculating an appropriate lighting time of the LEDs that is appropriate for each gradation so that an increment of an exposure amount between the gradations including a first gradation is fixed based on the highest gradation appropriate exposure amount, forming a lighting clock having a gradation pulse coinciding with a multiple of a reference pulse of its own reference clock with timing substantially the same as each appropriate lighting time, and setting the formed lighting clock; and LED driving means for counting the number of gradation pulses by receiving the lighting clock set by the setting means in accordance with a gradation of inputted image data, and lighting the LEDs until each number of gradations is reached.

5. An image forming apparatus having an LED print head where a multiplicity of LEDs capable of exposing a surface of a photoreceptor in a plurality of gradations are arranged, said image forming apparatus comprising:

setting means for calculating a highest gradation appropriate exposure amount appropriate for a highest gradation from a sensitivity characteristic of the photoreceptor and a light quantity characteristic of the LED print head, calculating a highest gradation appropriate lighting time of the LEDs that is appropriate for a highest gradation and to which a loss time at the time of start of lighting is added and an appropriate lighting time of the LEDs that is appropriate for each of other gradations and to which the loss time is added based on the highest gradation appropriate exposure amount, and setting a lighting time of each gradation based on the highest gradation appropriate lighting time and each appropriate lighting time; and LED driving means for lighting the LEDs for the lighting time set by the setting means in accordance with a gradation of inputted image data.

6. An image forming apparatus having an LED print head where a multiplicity of LEDs capable of exposing a surface of a photoreceptor in a plurality of gradations are arranged, said image forming apparatus comprising:

setting means for calculating a highest gradation appropriate exposure amount appropriate for a highest gradation from a sensitivity characteristic of the photoreceptor and a light quantity characteristic of the LED print head, calculating an appropriate lighting time of the LEDs that is appropriate for each gradation and to which a loss time at the time of start of lighting is added so that an increment of an exposure amount between the gradations including a first gradation is fixed based on the highest gradation appropriate exposure amount, forming a lighting clock having a gradation pulse coinciding with a multiple of a reference pulse of its own reference clock with timing substantially the same as each appropriate lighting time, and setting the formed lighting clock; and LED driving means for counting the number of gradation pulses by receiving the lighting clock set by the setting means in accordance with a gradation of inputted image data, and lighting the LEDs until each number of gradations is reached.

7. An image forming apparatus according to claim 1, wherein said highest gradation appropriate lighting time fulfills the following expression:

$$T=(E\cdot 2.54^2\cdot 10^6)/(P\cdot M\cdot N)+\Delta T$$

where $E=a\cdot E_{1/2}=a\cdot E'\cdot(V_0-V_{1/2})/(V_0-V)$, T is the highest gradation appropriate lighting time, ΔT is the loss time at the time of start of lighting, P is an average light quantity per LED, M is a main scanning resolution, N is a sub scanning resolution, $E_{1/2}$ is the highest gradation appropriate exposure amount, a is a fixed coefficient, $E_{1/2}$ is a half decay exposure amount, E' is an exposure amount of the photoreceptor when sensitivity is measured, $V_0$ is a dark potential of the photoreceptor, $V_{1/2}$ is a light potential at the time of half decay exposure, and V is a light potential of the photoreceptor when sensitivity is measured.

8. An image forming apparatus according to claim 2, wherein said appropriate lighting time fulfills the following expression:

$$T_{n/m}=\{n/(m-1)\}\cdot(E\cdot 2.54^2\cdot 10^6)/(P\cdot M\cdot N)+\Delta T$$

where $E=a\cdot E_{1/2}=a=E'\cdot(V_0-V_{1/2})/(V_0-V)$, $T_{n/m}$ is the appropriate lighting time of an n-th gradation, ΔT is a loss time at the time of start of lighting, m is a number of gradations, n is an ordinal number for the gradations (=0, 1, . . . , m−1), P is an average light quantity per LED, M is a main scanning resolution, N is a sub scanning resolution, E is the highest gradation appropriate exposure amount, a is a fixed coefficient, $E_{1/2}$ is a half decay exposure amount, E' is an exposure amount of the photoreceptor when sensitivity is measured, $V_0$ is a dark potential of the photoreceptor, $V_{1/2}$ is a light potential at the time of half decay exposure, and V is a light potential of the photoreceptor when sensitivity is measured.

9. An image forming apparatus according to claim 2, wherein said appropriate lighting time fulfills the following expression:

$$T_{n/m}=\{n/(m-1)\}\cdot(E\cdot 2.54^2\cdot 10^6)/(P\cdot M\cdot N)\cdot(1+0.01\cdot\beta_1)/\{1+0.01\alpha_1\cdot(K'-K)\}+\Delta T(1+0.01\cdot\beta_2)/\{1+0.01\cdot\alpha_2\cdot(K'-K)\}$$

where $E=a\cdot E_{1/2}=a\cdot E'\cdot(V_0-V_{1/2})/(V_0-V)$, $T_{n/m}$ is the appropriate lighting time of an n-th gradation, ΔT is a loss time at the time of start of lighting, m is a number of gradations, n is an ordinal number for the gradations (=0, 1, . . . , m−1), K is a temperature detected by a temperature sensor, K' is a basic set temperature, $\alpha_1$ is a temperature correction coefficient in an effective lighting time, $\alpha_2$ is a temperature correction coefficient in the loss time at the time of start of lighting, $\beta_1$ is an image density correction coefficient in the effective lighting time, $\beta_2$ is an image density correction coefficient in the loss time at the time of start of lighting, P is an average light quantity per LED, M is a main scanning resolution, N is a sub scanning resolution, E is the highest gradation appropriate exposure amount, a is a fixed coefficient, $E_{1/2}$ is a half decay exposure amount, E' is an exposure amount of the photoreceptor when sensitivity is measured, $V_0$ is a dark potential of the photoreceptor, $V_{1/2}$ is a light potential at the time of half decay exposure, and V is a light potential of the photoreceptor when sensitivity is measured.

10. An image forming apparatus according to claim 7, wherein said a is 2 to 3.5.

11. An image forming apparatus according to claim 1, wherein said sensitivity characteristic of the photoreceptor is a light potential when sensitivity is measured, and said light quantity characteristic of the LED print head is an average light quantity per LED.

12. An image forming apparatus according to claim 1, wherein a surface of said photoreceptor is amorphous silicon.

13. An image forming apparatus according to claim 1, wherein a plurality of image forming units each comprising said photoreceptor, said LED print head, said setting means and said LED driving means are provided.

14. An image forming apparatus according to claim 4, wherein said increment between the gradation pulses of the lighting clock is fixed.

15. An image forming apparatus according to claim 4, wherein said increment between the gradation pulses of the lighting clock is substantially fixed.

* * * * *